United States Patent [19]

Banister

[11] 4,110,857

[45] Sep. 5, 1978

[54] RESILIENT FOAM CUSHION STRUCTURE

[75] Inventor: Peter George Banister, Lake Elmo, Minn.

[73] Assignee: Conwed Corporation, St. Paul, Minn.

[21] Appl. No.: 698,428

[22] Filed: Jun. 21, 1976

[51] Int. Cl.[2] ..... A47C 27/15; A47G 9/00; A61G 7/06

[52] U.S. Cl. ..... 5/337; 5/361 R

[58] Field of Search ..... 5/345, 355, 361, 337; 206/507; 217/26.5

[56] References Cited

U.S. PATENT DOCUMENTS

| | | | |
|---|---|---|---|
| 2,464,301 | 3/1949 | Francis | 5/361 R |
| 2,953,195 | 9/1960 | Turck | 5/361 B |
| 3,026,544 | 3/1962 | Persicke et al. | 5/361 R |
| 3,064,279 | 11/1962 | Finkle | 5/361 R |
| 3,197,357 | 7/1965 | Schulpen | 5/361 B |
| 3,323,152 | 6/1967 | Lerman | 5/361 R |
| 3,940,811 | 3/1976 | Tomikawa | 5/361 R |

FOREIGN PATENT DOCUMENTS

| | | | |
|---|---|---|---|
| 1,324,907 | 3/1963 | France | 5/345 R |
| 1,779,537 | 12/1971 | Fed. Rep. of Germany | 5/361 B |

*Primary Examiner*—Paul R. Gilliam
*Assistant Examiner*—Victor N. Sakran
*Attorney, Agent, or Firm*—Eyre, Mann, Lucas & Just

[57] ABSTRACT

A resilient foam cushion structure and method for producing same are disclosed. The structure comprises a plurality of foam sheets each having a plurality of tapered protuberances on at least one face thereof. The sheets are stacked face-to-face to form the cushion structure such that each protuberance of at least opposed pairs of sheets is offset and adjacent an opposed protuberance. The protuberance spacing is preferably arranged such that adjacent opposed protuberances will abut upon compression of the cushion structure. The method comprises placing foam sheets on a form having a plurality of tapered protuberances thereon and applying a vacuum thereto to form the sheets on the form.

9 Claims, 6 Drawing Figures

RESILIENT FOAM CUSHION STRUCTURE

The present invention relates to a resilient foam cushion structure and method of producing same.

Foam structures are well known in the art for use as cushioning in the furniture, bedding and packaging industries and as flotation. See, for example, U.S. Pat. Nos. 2,836,228 and 2,902,091. The present invention is a significant improvement over known structures. For example, the present invention provides increased cushion performance, is extremely lightweight, provides an interlocking structure, requires only a single form for its production, and may be produced from foam sheets without the need for heated resins or expensive and complex molds and molding processes. Other advantages and improvements will become readily apparent hereinafter.

The present invention is embodied in and carried out by a resilient foam cushion structure comprising a plurality of foam sheets each having a plurality of protuberances on at least one face thereof in a selected arrangement, the protuberance arrangement and the plurality of sheets being stacked face-to-face such that each protuberance of at least an opposed pair of sheets is offset and adjacent at least one opposed protuberance, and in which the protuberances are preferably spaced such that adjacent opposed protuberances in the stacked cushion structure will abut upon compression of the stacked cushion structure. It is preferred that the sheets be identical. The resulting structure is a stack of individual foam sheets, at least each pair of which are interlocked due to the opposed offset protuberances. The individual sheets may be adhered to each other. Additionally, the cushion structure may be reinforced by providing reinforcing material between pairs of sheets or between individual sheets. Such reinforcing material advantageously comprises a plastic net-like product. The cushion structure is especially suited for use in bedding box springs and the interlocking nature of the cushion finds particular advantage in environments in which layers of foam cushion material are likely to move and separate relative to each other during use, such as in automobile seats. The use in marine cushion structures is also highly desirable because of the excellent flotation of these products.

These and other aspects of the present invention will be more apparent from the following description and drawings which illustrate the invention by way of an example and in which like numbers refer to like parts.

Figure 1:
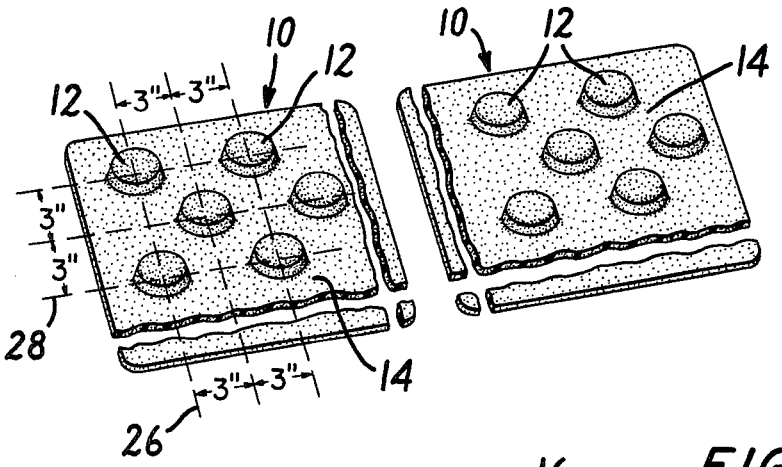
FIG. 1 shows an isometric view, partly broken-away, of two sheets according to the invention.

Referring to FIG. 1, there are shown two sheets 10 each having a plurality of generally tubular tapered hollow protuberances 12 on one face 14 thereof. As shown, each of the protuberances is in the shape of a truncated cone and, for strength and cost reasons, this is the preferred construction. This is especially true since it enables adjacent protuberances to abut and reinforce each other when compressive force is applied. The sheets 10 are identical and are shown having different portions thereof broken-away wherein only six protuberances and a corner portion of each sheet are completely shown. The sheet material is a foamed, flexible plastic, such as polyurethane, polyisoprene, polybutadiene or the like but preferably low density polyethylene foam.

Figure 2:
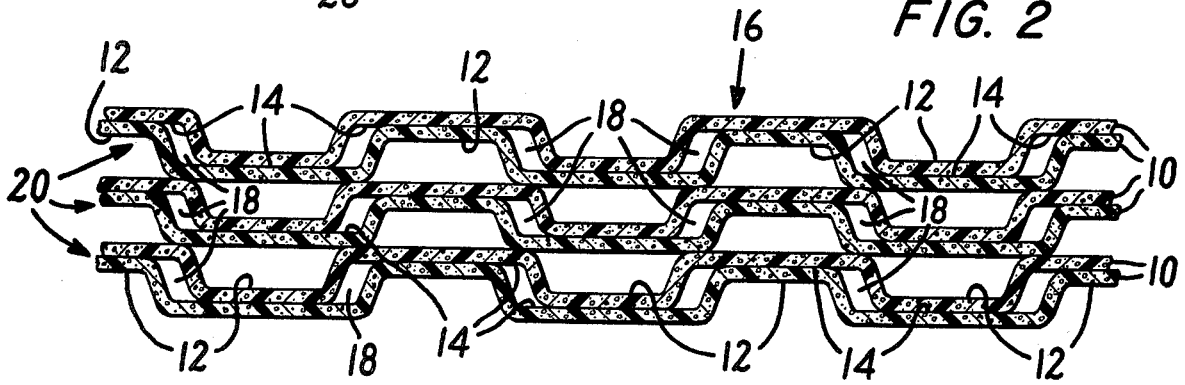
FIG. 2 shows a side cross-section view of the sheets of FIG. 1 stacked according to the invention.
Figure 3:
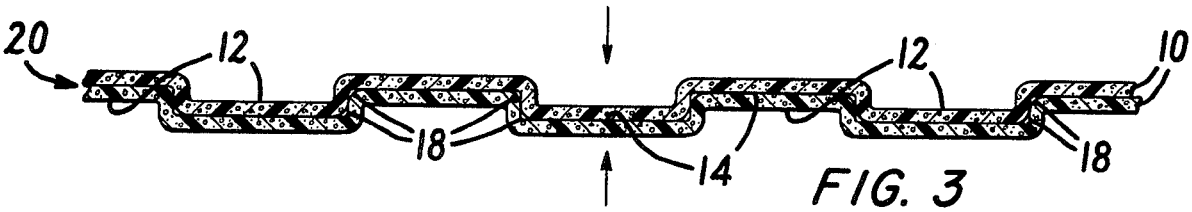
FIG. 3 shows two sheets of FIG. 1 under compression.

The protuberance spacing is chosen such that when one sheet is rotated 180° onto the other sheet, and thereby stacked face-to-face into structure 16, the protuberances are offset as shown in FIG. 2. The protuberance spacing is further arranged such that spaces 18 between protuberances 12 are at least partially filled by adjacent protuberances which preferably abut at least to a certain extent upon the application of sufficient compression to structure 16 as shown in FIG. 3, the compression being applied between the directions of the arrows. Referring to FIG. 2, pairs 20 of stacked sheets 10 are shown. The protuberances 12 are offset and are interlocking due to the offset thereof. The cushion structure comprises at least one pair of sheets 10. However, more than one pair is preferred and three pairs are shown. The cushion 16 itself may be secured in known manner by adhering individual sheets 10 together. The cushion structure may be further secured and finished in known manner by, for example, constraining the sides thereof so that relative movement between the individual sheets is prevented. For example, the cushion structure 16 may advantageously be used in a box spring-type bedding product wherein a box cover is sewn thereon and the sides thereof are secured in known manner.

Figure 4:
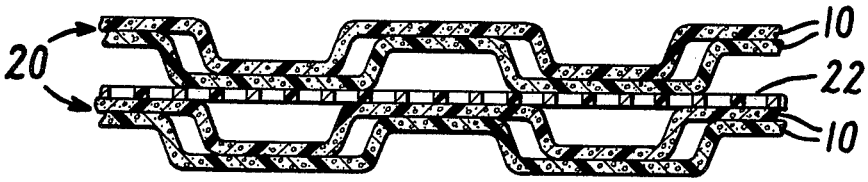
FIG. 4 shows a side view of another embodiment of the invention which includes a reinforcing material.

Referring now to FIG. 4, the cushion structure may be reinforced if desired by reinforcing members. Such a member 22 advantageously comprises a net-like product, which is well known in the art, see for example U.S. Pat. No. 3,252,181. The net 22 may be positioned between individual sheets 10 (not shown) or between pairs 20 of sheets 10 as shown in FIG. 4. The net may be secured to the sheets, if desired.

Figure 5:
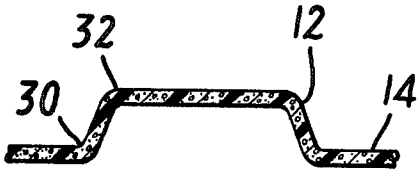
FIG. 5 shows a detail of a protuberance of the sheets of FIG. 1.

The dimensions and size of the sheets and the protuberances, as well as the positioning of the protuberances will vary in accordance with the use to which the cushion structure is to be put. By way of illustrating the best mode of practicing the present invention, the following dimensions and sizes, as shown in FIGS. 1 and 5 have been found to be suitable for use in a box spring. Columns 26 are spaced approximately three inches apart as are rows 28. As shown, however, the columns and rows are offset so that the protuberances comprising a column do not also comprise a row. As shown in FIG. 5, protuberance 12 has a base 30 diameter of approximately $2\frac{3}{4}$ inches and a top 32 diameter of approximately $2\frac{1}{2}$ inches. The height of the protuberance is approximately $1\frac{1}{4}$ inches. Accordingly, the shape of the protuberances is that of a truncated cone. In the best mode, it has been found that a cushion comprised of six sheets 10 of $\frac{1}{4}$ inch polyethylene foam as shown in FIG. 2 exhibits excellent cushioning and resilient characteristics. The sheets 10 are edged and trimmed, as shown in FIG. 1, to produce smooth edges and corners.

While particular ranges and specified dimensions and sizes have been set forth, it will be appreciated that the invention can be practiced with other dimensions and sizes depending upon the use to which the cushion is to be put and desired cushion characteristics such as compression resistance and resiliency. This applies equally to protuberance number and arrangement. Foam material selection may also vary in accordance with intended use and desired cushion characteristics. For example, the thickness of the foam material is preferably from about ⅛ to about ½ inch, and the height of the protuberances are preferably from about ½ to about 1½ inches. It is preferred that as the height of the protuberance decreases, the top and base dimensions thereof correspondingly decrease to maintain a generally tubular, tapered tubular or conical shape.

Foams suitable for the present invention are usually thermoplastic foams and especially low density polyethylene foams. Such foams are quite well known in the art. The foams normally have a density of less than about 10 pounds per cubic foot and in accordance with the present invention will preferably have a density of less than 6 pounds per cubic foot or even more preferably a density of less than 4 pounds per cubic foot. Best results in accordance with the present invention have been obtained with polyethylene foams of about 2.2 pounds per cubic foot but even those with a density as little as 1.5 pounds per cubic foot have been found to be desirable.

In accordance with the present invention, when using polyethylene foam, it has been found that a significant cost reduction and weight reduction is realizable over the heavier and more expensive inner springs, kapok material and foam rubber. Moreover, it has been found that polyethylene foam cushioning according to the present invention is quite durable and will last a long time.

Figure 6:
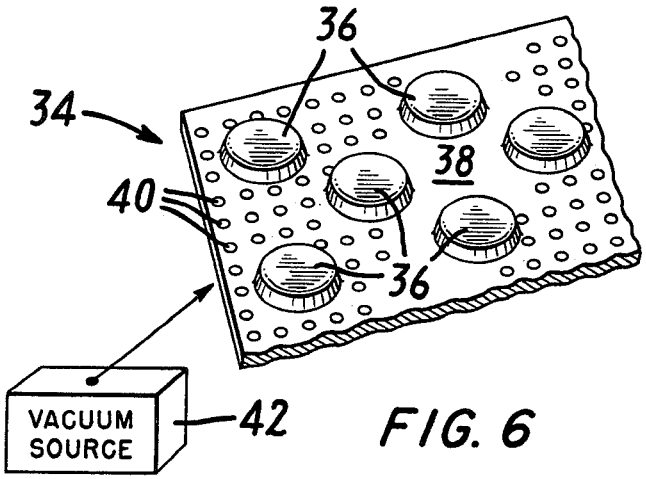
FIG. 6 shows an isometric view partly broken-away, of a form according to the invention.

The present invention also comprises a method for producing the cushion structure which may be carried out using the apparatus shown in FIG. 6. Referring to FIG. 6, a portion of form 34 is shown. Form 34 resembles an inverted muffin pan having selectively spaced cup-like protuberances 36 positioned about planar surface 38. The cup-like protuberances may be formed using aluminum cups having the general configuration of the sheet protuberances 12 as shown in FIG. 5. The cups are positioned and secured on a planar surface such as a sheet of plywood. Of course, an integral form of wood, metal, plastic or other suitable material may be used. Perforations 40 are provided through planar surface 38 and are communicated with a source of vacuum 42. It would also be suitable to use a screened planar surface on which are secured solid protuberances. The method according to the invention comprises the steps of positioning a foam sheet material on a form such as 34 comprising a planar surface having a plurality of perforations therethrough and a plurality of solid protuberances secured thereon applying a vacuum to the surface of the foam material contacting the form operative to draw the foam onto the form with sufficient force to conform the foam to the general shape of the form, and thereafter removing the foam from the form. Identical sheets are formed in accordance with the foregoing and stacked as described hereinbefore to produce the cushion structure of the invention. Vacuum forming the sheets 10, as described hereinabove, permits the use of an extremely simple form and permits forming the sheets 10 from a foam sheet rather than from a resin or the like. This simplifies the production of the sheets and reduces cost and capital expense. Moreover, skilled personnel are not required to oversee the vacuum forming method as opposed to the skilled personnel required to oversee resin forming and molding methods. In a similar manner, the sheet material may be heated and heat shrunk over the form without the use of vacuum if desired. However, the vacuum is preferred since it will better ensure a good product.

It will be appreciated that many modifications may be made to the disclosed embodiments without departing from the spirit and scope of the invention. For example, the sheets of the cushion structure may comprise solid protuberances and the sheets may further comprise protuberances on both faces thereof. Moreover, as mentioned hereinbefore, the size weight, density and shape of the individual sheets including the protuberances and the positioning thereof may vary in accordance with the use to which the cushion structure is to be put. Additionally, the content of the foam material may vary in accordance with said use.

The advantages of the present invention, as well as certain changes and modifications of the disclosed embodiments thereof, will be readily apparent to those skilled in the art. It is the applicants' intention to cover by their claims all those changes and modifications which could be made to the embodiments of the invention herein chosen for the purposes of the disclosure without departing from the spirit and scope of the invention.

What is claimed is:

1. A resilient foam cushion structure comprising at least two pairs of foam sheets, each said pair comprising first and second foam sheets of substantially uniform thickness, a first plurality of spaced protuberances of a predetermined height extending from one face of each said first sheet and aligned depressions in the other face thereof, said first plurality of protuberances having substantially flat regions in a plane parallel to said first foam sheet, said second foam sheet having a second plurality of spaced protuberances of substantially said predetermined height extending from one face thereof and aligned depressions in the other face thereof, said second plurality of protuberances having substantially flat regions in a plane parallel to said second foam sheet, said first plurality of protuberances facing said second foam sheet and said second plurality of protuberances facing said first foam sheet, the arrangement of said protuberances permitting said second plurality of protuberances to fit between said first plurality of protuberances with their flat regions abutting said first foam sheet, and permitting said first plurality of protuberances to fit between said second plurality of protuberances with their flat region abutting said second foam sheet and the spacing between the nearest points of at least some of the sidewalls of adjacent protuberances from said first and second plurality of protuberances being less than said predetermined height.

2. The cushion structure of claim 1, wherein each foam sheet is identical.

3. The cushion structure of claim 1 further comprising means to adhere at least each pair of foam sheets to other pairs of foam sheets.

4. The cushion structure of claim 1 further comprising reinforcing means positioned between at least two foam sheets of the structure.

5. The cushion structure of claim 4, wherein the reinforcing means comprises a net-like product.

6. The cushion structure of claim 4, wherein the reinforcing means is positioned between pairs of foam sheets, each pair comprising two interlocking foam sheets.

7. The cushion structure of claim 1, wherein the protuberances are substantially the shape of a truncated cone.

8. The cushion structure of claim 1, wherein the foam comprises low density polyethylene.

9. In a bedding box spring structure, a foam cushion structure comprising first and second foam sheets of substantially uniform thickness, a first plurality of spaced protuberances of a predetermined height extending from one face of each said first sheet and aligned depressions in the other face thereof, said first plurality of protuberances having substantially flat regions in a plane parallel to said first foam sheet, said second foam sheet having a second plurality of spaced protuberances of substantially said predetermined height extending from one face thereof and aligned depressions in the other face thereof, said second plurality of protuberances having substantially flat regions in a plane parallel to said second foam sheet, said first plurality of protuberances facing said second foam sheet and said second plurality of protuberances facing said first foam sheet, the arrangement of said protuberances permitting said second plurality of protuberances to fit between said first plurality of protuberances with their flat regions abutting said first foam sheet, and permitting said first plurality of protuberances to fit between said second plurality of protuberances with their abutting said second foam sheet and the spacing between the nearest points of at least some of the sidewalls of adjacent protuberances from said first and second plurality of protuberances being less than said predetermined height.

* * * * *

UNITED STATES PATENT AND TRADEMARK OFFICE

CERTIFICATE OF CORRECTION

PATENT NO. : 4,110,857

DATED : Sep. 5, 1978

INVENTOR(S) : Banister, Peter George

It is certified that error appears in the above-identified patent and that said Letters Patent are hereby corrected as shown below:

Column 6, line 11, insert after "their"
--flat regions--.

Signed and Sealed this

*Twenty-ninth* Day of *May 1979*

[SEAL]

*Attest:*

RUTH C. MASON
*Attesting Officer*

DONALD W. BANNER
*Commissioner of Patents and Trademarks*